US011215400B2

(12) United States Patent
Nakamura et al.

(10) Patent No.: US 11,215,400 B2
(45) Date of Patent: Jan. 4, 2022

(54) HEAT EXCHANGER

(71) Applicant: Mitsubishi Hitachi Power Systems, Ltd., Kanagawa (JP)

(72) Inventors: Taichi Nakamura, Yokohama (JP); Hiroshi Yano, Yokohama (JP); Shungo Fukuma, Yokohama (JP); Satoshi Hiraoka, Yokohama (JP); Masanori Tagashira, Yokohama (JP); Kenji Kirihara, Yokohama (JP)

(73) Assignee: MITSUBISHI POWER, LTD., Kanagawa (JP)

( * ) Notice: Subject to any disclaimer, the term of this patent is extended or adjusted under 35 U.S.C. 154(b) by 0 days.

(21) Appl. No.: 16/631,682

(22) PCT Filed: Sep. 20, 2018

(86) PCT No.: PCT/JP2018/034901
§ 371 (c)(1),
(2) Date: Jan. 16, 2020

(87) PCT Pub. No.: WO2019/069703
PCT Pub. Date: Apr. 11, 2019

(65) Prior Publication Data

US 2020/0166280 A1 May 28, 2020

(30) Foreign Application Priority Data

Oct. 5, 2017 (JP) ..... JP2017-195367

(51) Int. Cl.
*F28D 7/06* (2006.01)
*F28D 7/16* (2006.01)
(Continued)

(52) U.S. Cl.
CPC ..... *F28D 7/06* (2013.01); *F28D 7/1638* (2013.01); *F28F 9/013* (2013.01); *F28F 9/0209* (2013.01); *F28F 21/083* (2013.01)

(58) Field of Classification Search
CPC ..... F28F 9/013; F28F 9/0209; F28F 9/0131; F28F 9/0224; F28F 21/083; F28D 7/06; F28D 1/06
See application file for complete search history.

(56) References Cited

U.S. PATENT DOCUMENTS 1,803,035 A * 4/1931 Potter ..... F28F 9/22 165/161
2,299,455 A 10/1942 Bowman et al.
(Continued)

FOREIGN PATENT DOCUMENTS

JP 04351312 A * 12/1992
JP 5433461 3/2014

OTHER PUBLICATIONS

International Search Report dated Nov. 27, 2018 in International Application No. PCT/JP2018/034901.
(Continued)

*Primary Examiner* — Devon Russell
(74) *Attorney, Agent, or Firm* — Wenderoth, Lind & Ponack, L.L.P.

(57) ABSTRACT

A tube plate of a heat exchanger includes a tube plate base material to which ends of a plurality of heat transfer tubes are fixed, a first backplate that covers a surface of the tube plate base material on a first tube chamber side, and a fastener that includes at least a shaft section and fixes the first backplate to the tube plate base material. The first backplate includes heat transfer tube insertion holes through which a plurality of heat transfer tubes are inserted, and an insertion hole through which the shaft section is loosely inserted. The first backplate is joined to an end section of a
(Continued)

second partition wall on a first end side. The second partition wall, the first backplate, and the fastener are formed of a material having higher corrosion resistance than the tube plate base material.

9 Claims, 9 Drawing Sheets

(51) Int. Cl.

| | |
|---|---|
| ***F28F 9/013*** | (2006.01) |
| ***F28F 9/02*** | (2006.01) |
| ***F28F 21/08*** | (2006.01) |

(56) References Cited

U.S. PATENT DOCUMENTS 4,029,145 A * 6/1977 Pfouts ..... F28D 7/1646 165/161
4,288,109 A * 9/1981 Ellis ..... F28F 9/185 285/141.1
4,839,951 A * 6/1989 Boula ..... F28F 9/0132 29/890.051
5,544,700 A * 8/1996 Shagoury ..... F02C 7/14 165/139
6,095,238 A * 8/2000 Kawano ..... F28B 9/08 165/113
7,185,698 B1 * 3/2007 Bernert, Jr. ..... F28D 7/06 165/134.1
9,435,589 B2 * 9/2016 Scheerder ..... B01J 19/006
10,627,166 B2 * 4/2020 Nakamura ..... F28F 9/0209
2006/0076126 A1 * 4/2006 Fandry ..... F28D 7/06 165/159
2009/0013676 A1 * 1/2009 Capelle ..... F01N 5/02 60/320
2013/0340971 A1 * 12/2013 Nishioka ..... F22B 37/206 165/69

OTHER PUBLICATIONS

Written Opinion of the International Searching Authority dated Nov. 27, 2018 in International Application No. PCT/JP2018/034901.

* cited by examiner

HEAT EXCHANGER

TECHNICAL FIELD

The present invention relates to a heat exchanger.

This application claims priority based on JP 2017-195367 A filed in Japan on Oct. 5, 2017, the contents of which are incorporated herein by reference.

BACKGROUND ART

As a heat exchanger, there is a multitube heat exchanger which includes an outer cylinder, a tube plate partitioning the inside of the outer cylinder into a tube-interior fluid chamber and a tube-exterior fluid chamber, and a plurality of heat transfer tubes fixed to the tube plate and arranged in the tube-exterior fluid chamber. In such a heat exchanger, for example, there is a case where the plurality of heat transfer tubes are supplied with a heating medium and a corrosive fluid is flowed into the tube-exterior fluid chamber in the outer cylinder to heat the corrosive fluid. In a case where a member defining the tube-exterior fluid chamber is formed of, for example, carbon steel, when a corrosive fluid flows into the tube-exterior fluid chamber, the member defining the tube-exterior fluid chamber is corroded. Therefore, the following patent documents disclose a multitube heat exchanger that suppresses corrosion of a member defining a tube-exterior fluid chamber.

A tube plate of this heat exchanger includes a base material formed of carbon steel and a surface material formed of stainless steel. The surface material is disposed on the surface of the base material on the tube-exterior fluid chamber side.

CITATION LIST

Patent Document

Patent Document 1: JP 5433461 B

SUMMARY OF INVENTION

Technical Problem

In the heat exchanger described in Patent Document 1, it is possible to suppress corrosion of the tube plate while reducing the amount of use of expensive materials. However, in this heat exchanger, a thermal elongation difference between the base material and the surface material occurs during use of the heat exchanger due to a difference between a linear expansion coefficient of carbon steel and a linear expansion coefficient of stainless steel. Therefore, the durability of the heat exchanger is reduced unless the thermal elongation difference between materials is taken into consideration.

An object of the present invention is to provide a heat exchanger capable of suppressing an increase in manufacturing cost and progression of corrosion, and further suppressing deterioration in durability.

Solution to Problem

In order to solve the above problem, the following configuration is adopted.

According to a first aspect of the present invention, a heat exchanger includes: an outer cylinder having a cylindrical shape with both ends closed; a tube plate partitioning, at a position close to a first end of the both ends, an inside of the outer cylinder into a tube-interior fluid chamber on a side where the first end is located and a tube-exterior fluid chamber on a side where a second end is located; a plurality of heat transfer tubes arranged in the tube-exterior fluid chamber and including at least one end that is fixed to the tube plate and faces the tube-interior fluid chamber; and a partition wall partitioning the tube-exterior fluid chamber into a first tube chamber, in which an inlet side tube group is present as a collection of inlet side tube sections extending from inlet ends of the plurality of heat transfer tubes, and a second tube chamber, in which an outlet side tube group is present as a collection of outlet side tube sections extending from outlet ends of the plurality of heat transfer tubes. The tube plate includes a tube plate base material to which end sections of the plurality of heat transfer tubes are fixed, a first backplate covering a surface of the tube plate base material on a side where the first tube chamber is located, and a fastener that includes at least a shaft section and is configured to fix the first backplate to the tube plate base material. The first backplate includes heat transfer tube insertion holes through which the plurality of heat transfer tubes are inserted and an insertion hole through which the shaft section is loosely inserted, and the first backplate is joined to an end section of the second partition wall on the side where the first end is located. The partition wall, the first backplate, and the fastener are formed of a material having a higher corrosion resistance than the tube plate base material.

According to this first aspect, a first backplate formed of a material having a higher corrosion resistance than the tube plate base material is fixed to the surface of the tube plate base material on the first tube chamber side. Therefore, when the temperature of the corrosive fluid flowing in the first tube chamber is higher than that of the corrosive fluid flowing in the second tube chamber, progression of corrosion by the surface of the tube plate base material on the first tube chamber side contacting the corrosive fluid can be suppressed. Further, the first backplate is connected to the tube plate base material by a screw fastener and is joined to the end section of the second partition wall on the side where the first end is located. That is, the first backplate is joined only to the second partition wall, not to the outer cylinder, and is fixed to the outer plate base material only by a fastener in which the shaft section is loosely inserted into the insertion hole. Therefore, even in a case where a thermal elongation difference occurs between the tube plate base material and the outer cylinder and the first backplate, when the force acting on the first backplate due to the thermal elongation difference exceeds the fixing force of the fastener, the first backplate can be slightly displaced with respect to the fastener. Therefore, it is possible to prevent excessive stress from being applied to the first backplate due to the thermal elongation difference.

Therefore, it is possible to suppress an increase in manufacturing cost and progression of corrosion, and to suppress a decrease in durability.

According to a second aspect of the present invention, the heat exchanger according to the first aspect may include: an inner cylinder arranged in the tube-exterior fluid chamber and covering the plurality of heat transfer tubes and the second partition wall; a space partition member that is disposed between the outer cylinder and the inner cylinder and that partitions a space between the outer cylinder and the inner cylinder on the side where the first tube chamber is located into the side where the first end is located and the side where the second end is located; a first nozzle stub provided in the outer cylinder at a position closer to the second end than to the space partition member on the side where the first tube chamber is located with respect to the partition wall or at a position on a side where the second tube chamber is located with respect to the partition wall; and a second nozzle stub provided in the outer cylinder on the side where the first tube chamber is located with respect to the partition wall and at a position between the space partition member and the tube plate. The inner cylinder may be open on the side where the first end is located and closed on the side where the second end is located. The partition wall may be joined to the inner cylinder to divide the inner cylinder into two sections in a radial direction to form the first tube chamber and the second tube chamber. The space partition member may be joined to an outer peripheral surface of the inner cylinder and displaceable with respect to an inner peripheral surface of the outer cylinder without being joined to the inner peripheral surface of the outer cylinder. The inner cylinder and the space partition member may be formed of a material having a higher corrosion resistance than the tube plate base material.

According to the second aspect, the inner cylinder and the space partition member are formed of a material having a higher corrosion resistance than the tube plate base material. Therefore, even when a high-temperature corrosive fluid flows in the first tube chamber, corrosion of the inner cylinder and the space partition member can be suppressed. Further, the inner cylinder and the second partition wall are joined, and the space partition member is not joined to the outer cylinder. Therefore, even when a thermal elongation difference occurs between the inner cylinder and the space partition member with respect to the outer cylinder, stress can be prevented from being applied to the space partition member and the inner cylinder.

According to a third aspect of the present invention, the heat exchanger according to the second aspect may include a second backplate that is disposed to cover a region between the space partition member and the tube plate on the side where the first tube chamber is located in the inner peripheral surface of the outer cylinder and that is formed of a material having a higher corrosion resistance than the outer cylinder.

In this third aspect, the region between the space partition member and the tube plate, in which the second nozzle stub is provided, is covered with the second backplate in the inner peripheral surface of the outer cylinder. Therefore, when a high-temperature corrosive fluid flows in or out of the second nozzle, the high-temperature corrosive fluid can be prevented from contacting the inner peripheral surface of the outer cylinder.

According to a fourth aspect of the present invention, the heat exchanger according to the second or third aspect may include a first seal that is disposed to extend between the inner peripheral surface of the outer cylinder and either one of a surface, on the side where the first end is located, and a surface, on the side where the second end is located, of the space partition member and that closes a gap generated between the space partition member and the inner peripheral surface of the outer cylinder while allowing the space partition member to be displaceable with respect to the outer cylinder.

According to the fourth aspect, even when a gap is formed between the space partition member and the outer cylinder, the gap is closed by the first seal, so that the corrosive fluid can be prevented from flowing through the gap.

According to a fifth aspect of the present invention, the heat exchanger according to any one of the second to fourth aspects may include a second seal that is disposed to extend between the inner peripheral surface of the outer cylinder and either one of a surface, on the side where the first tube chamber is located, and a surface, on the side where the second tube chamber is located, of the partition wall and that closes a gap generated between the partition wall and the inner peripheral surface of the outer cylinder while allowing the partition wall to be displaceable with respect to the outer cylinder.

According to the fifth aspect, even when a gap is formed between the partition wall and the outer cylinder, since the gap between the partition wall and the outer cylinder is closed while the partition wall can be displaced with respect to the outer cylinder by the second seal, it is possible to prevent the flow of corrosive fluid between the first tube chamber and the second tube chamber.

According to a sixth aspect of the present invention, the second backplate according to the third aspect may be divided into a plurality of sections along the inner peripheral surface of the outer cylinder.

In the sixth embodiment, since the inner peripheral surface of the outer cylinder is covered with the second backplate divided into a plurality of sections, for example, deformation of the second backplate caused by a thermal elongation difference in the axial direction between the outer cylinder and the second backplate can be suppressed.

According to a seventh aspect of the present invention, the second nozzle stub according to any one of the second to sixth aspects may be formed of a material having a higher corrosion resistance than the outer cylinder.

In the seventh aspect, since the first nozzle stub is formed of a material having a high corrosion resistance, it is possible to suppress progression of corrosion of the first nozzle stub in contact with the corrosive fluid when the high-temperature corrosive fluid flows in and out through the first nozzle stub.

According to an eighth aspect of the present invention, the fastener according to any one of the first to seventh aspects may include a washer that has an inner diameter larger than an outer diameter of the shaft section and smaller than an inner diameter of the insertion hole and that has an outer diameter larger than an inner diameter of the insertion hole.

In the eighth aspect, since the washer is provided, it is possible to prevent the corrosive fluid from entering between the first backplate and the tube plate through the insertion hole.

According to a ninth aspect of the present invention, the first seal according to the fourth aspect may be formed in a sheet shape elastically deformed so that a concave surface is disposed on a side in which pressure is relatively high.

According to a tenth aspect of the present invention, the second seal according to the fifth aspect may be formed in a sheet shape elastically deformed so that a concave surface is disposed on a side in which pressure is relatively high.

In the ninth and tenth aspects, the first seal and the second seal formed in the shape of a sheet are elastically deformed to close the gap. Therefore, even when the size of the gap changes, it is possible to suppress deterioration of the sealing performance.

Advantageous Effect of Invention

According to the above-described heat exchanger, it is possible to suppress an increase in manufacturing cost and progression of corrosion, and further to suppress a decrease in durability.

DESCRIPTION OF EMBODIMENTS

First Embodiment

Next, a heat exchanger according to a first embodiment of the present invention will be described with reference to the drawings.

Figure 1:
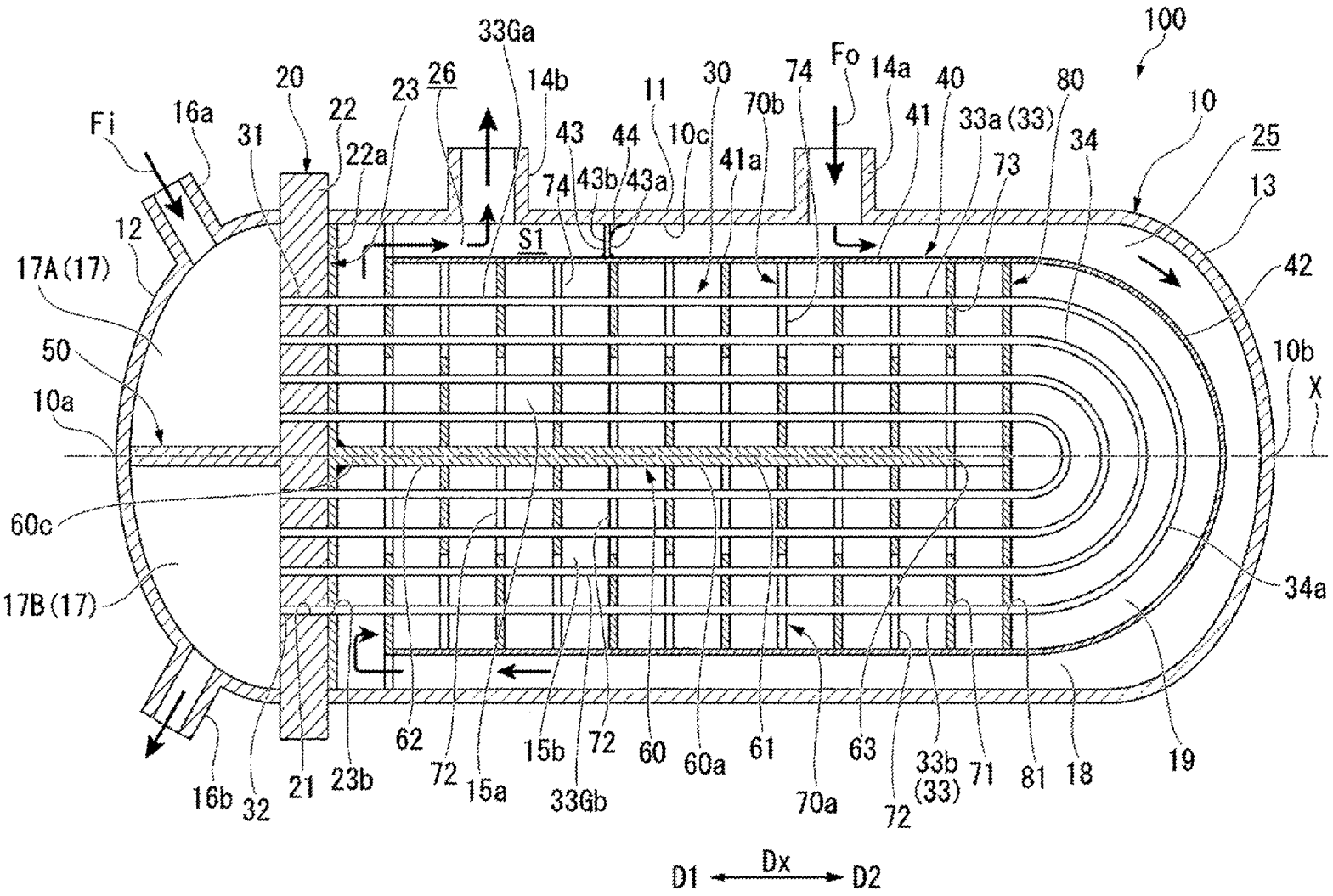
FIG. 1 is a configuration diagram illustrating a schematic configuration of a heat exchanger according to a first embodiment of the present invention.

FIG. 1 is a configuration diagram illustrating a schematic configuration of a heat exchanger according to the first embodiment of the present invention.

As illustrated in FIG. 1, the heat exchanger 100 according to the first embodiment is a so-called shell and tube type heat exchanger, which includes an outer cylinder 10, a tube plate 20, a plurality of heat transfer tubes 30, an inner cylinder 40, a first partition wall 50, a second partition wall 60, a plurality of first baffles 70*a*, second baffles 70*b*, and a tube support plate 80.

The outer cylinder 10 includes a trunk part 11 that is cylindrical centered around the axis X, and a first end plate 12 and a second end plate 13, which are connected to the ends of the trunk part 11. The trunk part 11 includes a first nozzle stub 14*a* and a second nozzle stub 14*b*. The first nozzle stub 14*a* communicates a second tube chamber 15*b* described later with the outside of the outer cylinder 10, and the second nozzle stub 14*b* communicates a first tube chamber 15*a* described later with the outside of the outer cylinder 10.

In the following description, a direction in which the axis X extends is referred to as an axial direction Dx, and one side of the axial direction Dx is referred to as a first end side D1, and the other side thereof is referred to as a second end side D2.

The first end plate 12 is connected to the end of the trunk part 11 on the first end side D1, and closes the opening of the trunk part 11 on the first end side D1. The first end plate 12 has a curved surface whose inner surface is smoothly recessed in a concave shape to a side away from the second end plate 13, that is, to the first end side D1. The first end plate 12 is provided with a tube-interior side inlet nozzle 16*a* and a tube-interior side outlet nozzle 16*b*. The tube-interior side inlet nozzle 16*a* allows a tube-interior fluid Fi as a heat medium to flow into the inside of the tube-interior fluid chamber 17 from the outside of the outer cylinder 10. The tube-interior side outlet nozzle 16*b* allows the tube-interior fluid Fi to flow out from the inside of the tube-interior fluid chamber 17 to the outside of the outer cylinder 10.

The second end plate 13 is connected to the end of the trunk part 11 on the second end side D2, and closes the opening of the trunk part 11 on the second end side D2. The second end plate 13 has a curved surface whose inner surface is smoothly recessed in a concave shape to a side away from the first end plate 12, that is, to the second end side D2. The outer cylinder 10 is provided with the trunk part 11, the first end plate 12, and the second end plate 13 to form a cylindrical shape with both ends closed. In the first end plate 12, an endmost section on the first end side D1 forms a first end 10*a* of the outer cylinder 10. In the second end plate 13, an endmost section on the second end side D2 forms a second end 10*b* of the outer cylinder 10.

The tube plate 20 partitions the inside of the outer cylinder 10 into a tube-interior fluid chamber 17 on the first end side D1 and a tube-exterior fluid chamber 18 on the second end side D2 at a position closer to the first end side D1 than to the center of the outer cylinder 10 in the axial direction Dx. More specifically, the tube plate 20 is formed at the boundary between the first end plate 12 and the trunk part 11 to partition the tube-interior fluid chamber 17 and the tube-exterior fluid chamber 18. The tube plate 20 according to the present embodiment is substantially disk-shaped. The tube plate 20 is formed with a plurality of tube holes 21 extending in the axial direction Dx. An inlet end 31 and an outlet end 32 of the heat transfer tube 30 are inserted into and fixed to the tube holes 21.

The heat transfer tube 30 is formed in a U-shape having a straight-tube section 33 and a curved-tube section 34. The straight-tube section 33 includes an inlet side tube section 33*a* and an outlet side tube section 33*b*. The inlet side tube section 33*a* has an inlet end 31 at one end thereof and is connected to the curved-tube section 34 at the other end thereof. The inlet end 31 of the inlet side tube section 33*a* serves as an inlet into which the tube-interior fluid H flows into the heat transfer tube 30. The outlet side tube section 33*b* has an outlet end 32 at one end thereof and is connected to the curved-tube section 34 at the other end thereof. The outlet end 32 of the outlet side tube section 33*b* serves as an outlet through which the tube-interior fluid Fi flows out from the inside of the heat transfer tube 30. Both the inlet side tube section 33*a* and the outlet side tube section 33*b* extend in the axial direction Dx. The inlet end 31 and the outlet end 32 are respectively fixed to the tube plate 20.

The inlet end 31 is fixed while inserted into a tube hole 21 formed in one semicircle (upper half circle in FIG. 1) of the tube plate 20. As a result, the inlet end 31 faces the tube-interior fluid chamber 17. Moreover, the outlet end 32 is fixed while inserted into a tube hole 21 formed in the other semicircle (lower half circle in FIG. 1) of the tube plate 20. As a result, the outlet end 32 faces the interior fluid chamber 17. On the other hand, most of the straight-tube section 33 and all of the curved-tube section 34 are disposed in the tube-exterior fluid chamber 18.

The inner cylinder 40 is disposed inside the outer cylinder 10. More specifically, the inner cylinder 40 is formed so as to surround the straight-tube section 33 and the curved-tube section 34 from the outside in the tube-exterior fluid chamber 18. The inner cylinder 40 includes a trunk part 41, an end plate 42, and a space partition member 43. The trunk part 41 is formed in a cylindrical shape centered around the axis X. The trunk part 41 is separated from the inner surface of the trunk part 11 of the outer cylinder 10 toward the side closer to the axis X. In other words, the trunk part 41 has an outer diameter smaller than the inner diameter of the trunk part 11 of the outer cylinder 10.

The end plate 42 is connected to the second end side D2 of the trunk part 41. That is, the end plate 42 closes the opening of the second end side D2 of the trunk part 41. The end plate 42 has an inner surface which is smoothly recessed to the second end side D2. In particular, the inner surface of the end plate 42 smoothly curves along the largest curved-tube section 34*a* having the largest radius of curvature among the curved-tube sections 34. The outer surface of the end plate 42 is separated from the inner surface of the second end plate 13 of the outer cylinder 10 toward the inside of the second end plate 13.

On the other hand, the first end side D1 of the trunk part 41 is open. That is, the end plate or the like is not provided at the end of the first end side D1 of the trunk part 41. The end (in other words, an opening) of the first end side D1 of the trunk part 41 according to the present embodiment is located between the second nozzle stub 14*b* and the tube plate 20.

The tube support plate 80 partitions the inside of the inner cylinder 40 into a curved-tube chamber 19, in which the curved-tube section 34 is arranged, and other chambers. The tube support plate 80 is formed in a flat plate shape extending in a direction intersecting the axis X. A plurality of tube holes 81 through which the heat transfer tubes 30 pass in the axial direction Dx are formed in the tube support plate 80. The heat transfer tubes 30 are inserted through the tube holes 81 and supported by the tube support plate 80.

Figure 2:
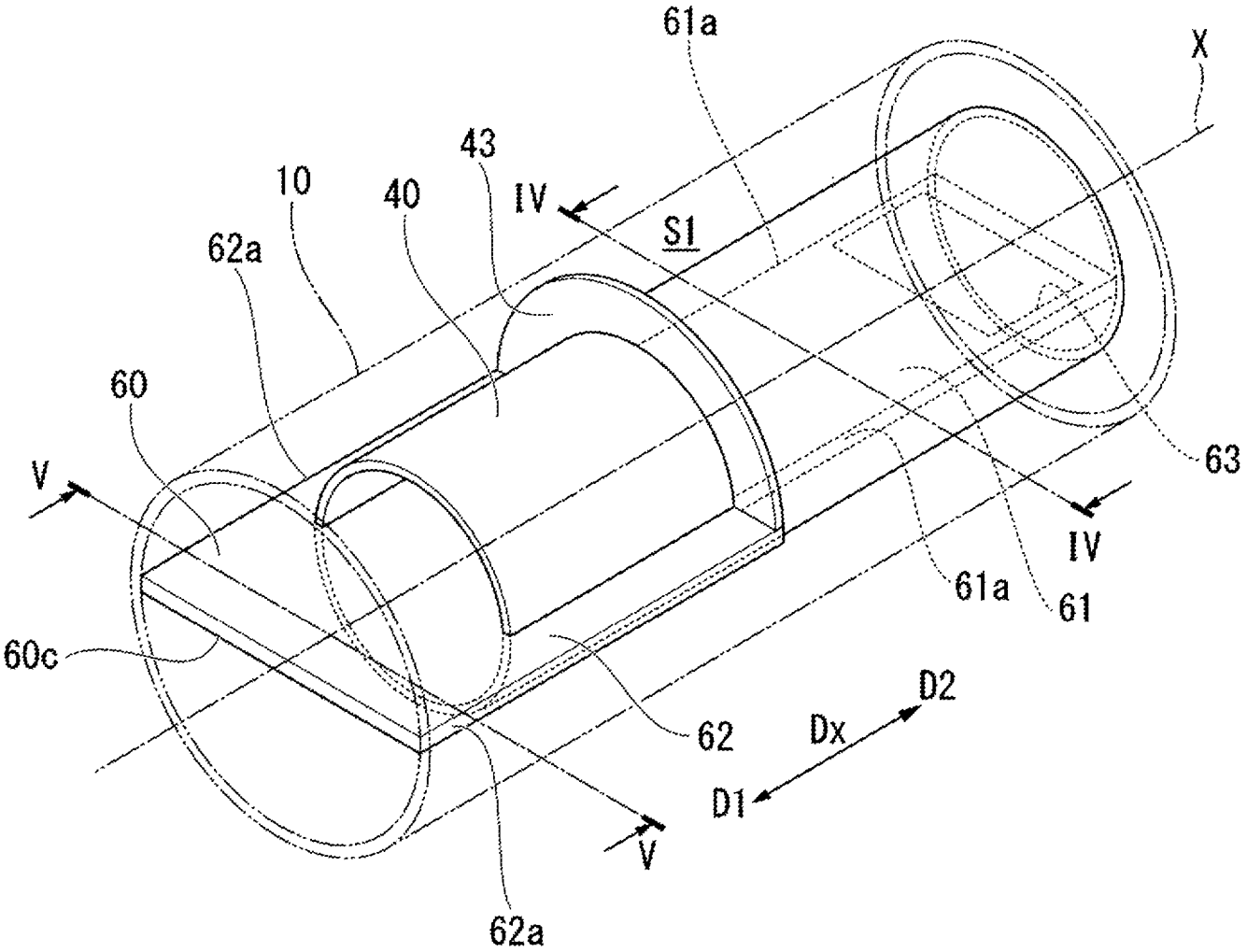
FIG. 2 is a perspective view illustrating a schematic configuration of an inner cylinder, a second partition wall, and a space partition member according to the first embodiment of the present invention.

FIG. 2 is a perspective view illustrating a schematic configuration of an inner cylinder, a second partition wall, and a space partition member according to the first embodiment of the present invention. In the drawings other than FIG. 1, the heat transfer tube 30, the first baffle 70*a* and the second baffle 70*b* are omitted for convenience of illustration.

As illustrated in FIG. 1 and FIG. 2, the space partition member 43 partitions the space S1 formed between the outer peripheral surface 41*a* of the trunk part 41 and the inner peripheral surface 10*c* of the outer cylinder 10 in the axial direction Dx. The space partition member 43 is formed in a flat plate shape extending in the radial direction centered around the axis X. The space partition member 43 is formed in a semicircular shape when viewed in the axial direction Dx (see FIG. 2). The space partition member 43 that is semicircular is disposed on the side close to the second nozzle stub 14*b* (upper half of FIG. 1) with respect to a position in the axis X.

The space partition member 43 is joined to the outer peripheral surface 41*a* of the trunk part 41 of the inner cylinder 40 by welding or the like. On the other hand, the space partition member 43 is not joined to the inner peripheral surface of the outer cylinder 10 by welding or the like, but is instead provided with a first seal 44 configured to close a gap generated between the space partition member 43 and the inner peripheral surface 10*c* of the outer cylinder 10.

Figure 3:
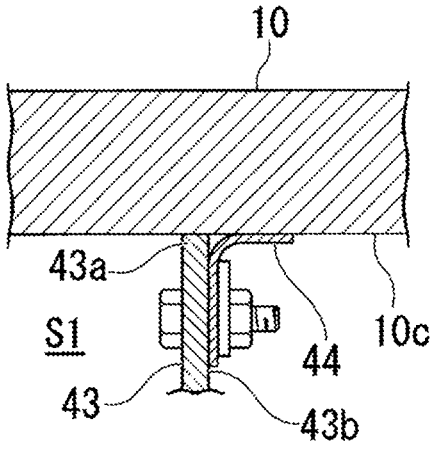
FIG. 3 is an enlarged cross-sectional view of a first seal according to the first embodiment of the present invention.

FIG. 3 is an enlarged cross-sectional view of the first seal according to the first embodiment of the present invention.

As the first seal 44, a so-called lamiflex seal plate can be used. As illustrated in FIG. 3, the first seal 44 is formed into a sheet shape, and is attached along an edge section 43*a* of the space partition member 43 on the side close to the inner peripheral surface 10*c* of the outer cylinder 10. The first seal 44 is disposed so as to extend between a surface 43*b* facing the second end side D2 of the space partition member 43 and an inner peripheral surface 10*c* of the outer cylinder 10. The first seal 44 illustrated in the present embodiment is bolted to the surface 43*b* of the space partition member 43. More specifically, the first seal 44 is placed in an elastically deformed state, and is elastically deformed and curved such that a concave curved surface is formed on the second end side D2 which is a high-pressure side. Thus, the first seal 44 bolted is in a state of pressing the inner peripheral surface 10*c* and the surface 43*b*. Further, the method of fixing the first seal 44 is not limited to bolting. The first seal 44 can be formed of, for example, such as stainless metal having high corrosion resistance.

As illustrated in FIG. 1, the first partition wall 50 partitions the inside of the tube-interior fluid chamber 17 into an inlet chamber 17A and an outlet chamber 17B. The inlet chamber 17A faces the inlet end group, which is a collection of the inlet ends 31 of the heat transfer tubes 30, and the outlet chamber 17B faces the outlet end group, which is a collection of the outlet ends 32 of the heat transfer tubes 30. The inlet chamber 17A communicates with the outside through a tube-interior side inlet nozzle 16*a* disposed on the inlet chamber 17A side of the first partition wall 50, and the outlet chamber 17B communicates with the outside through a tube-interior side outlet nozzle 16*b* disposed on the outlet chamber 17B side of the first partition wall 50.

The second partition wall 60, together with the inner cylinder 40 and the space partition member 43, partitions the inside of the tube-exterior fluid chamber 18 into a first tube chamber 15*a* and a second tube chamber 15*b*. An inlet side tube group 33Ga, which is a collection of the inlet side tube sections 33*a* described above, is arranged in the first tube chamber 15*a*, and an outlet side tube group 33Gb, which is a collection of the outlet side tube sections 33*b* described above, is arranged in the second tube chamber 15*b*. The second partition wall 60 according to the present embodiment is located on the axis X and is formed in a flat plate shape extending in the horizontal direction.

As illustrated in FIG. 2, the second partition wall 60 includes a small width section 61 disposed on a second end side D2 of the space partition member 43, and a large width section 62 disposed on a first end side D1 of the space partition member 43. The second partition wall 60 according to the present embodiment is formed of a metal material having a higher corrosion resistance than the tube plate base material 22 of the tube plate 20 described later.

Figure 4:
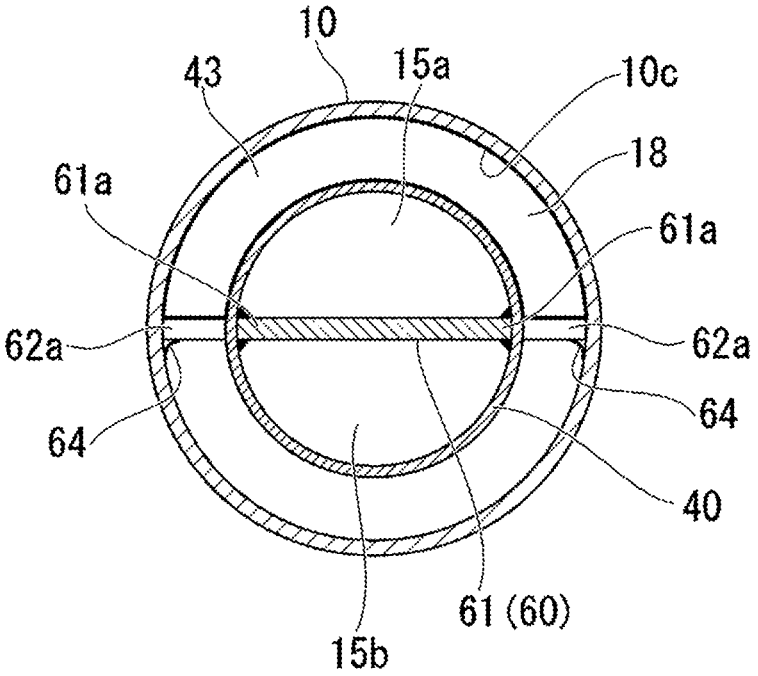
FIG. 4 is a cross-sectional view taken along the IV-IV line of FIG. 2.
Figure 5:
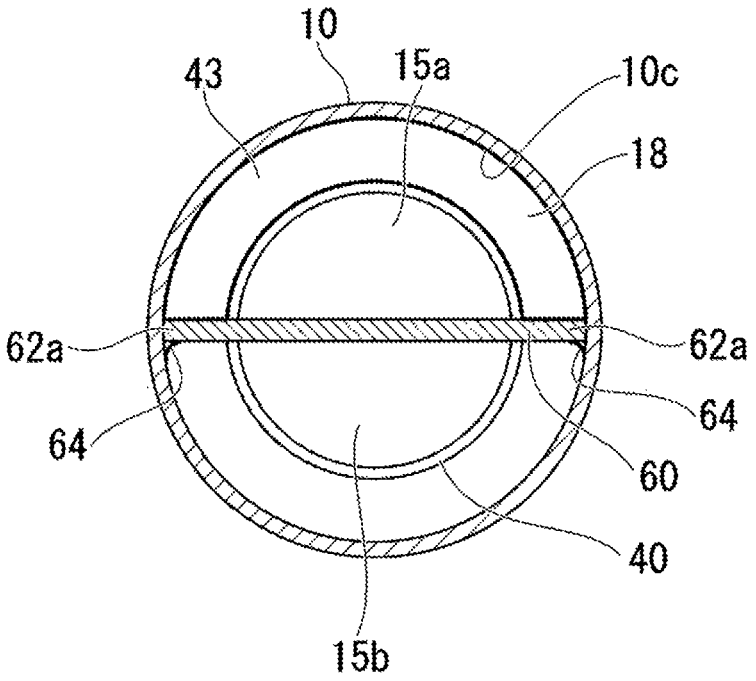
FIG. 5 is a cross-sectional view taken along the V-V line of FIG. 2.
Figure 6:
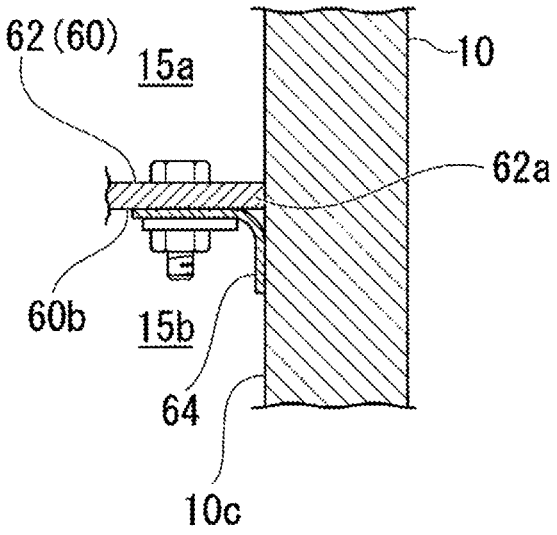
FIG. 6 is an enlarged cross-sectional view of a second seal according to the first embodiment of the present invention.

FIG. 4 is a cross-sectional view taken along the IV-IV line of FIG. 2. FIG. 5 is a cross-sectional view taken along the V-V line of FIG. 2. FIG. 6 is an enlarged cross-sectional view of a second seal according to the first embodiment of the present invention.

As illustrated in FIG. 4, the small width section 61 of the second partition wall 60 is joined to the inner peripheral surface of the inner cylinder 40 with no gap by welding or the like at both edge sections 61*a* in the width direction thereof centered around the axis X. The small width section 61 includes an opening forming section 63 configured to form a flow path for communicating the first tube chamber 15*a* and the second tube chamber 15*b* (see FIG. 1 and FIG. 2). The opening forming section is disposed endmost to the tube support plate 80 side of the small width section 61, that is, endmost to the second end side D2 of the second partition wall 60.

Both edge sections 62*a* of the large width section 62 in the width direction centered around the axis X are not fixed to the inner peripheral surface 10*c* of the outer cylinder 10. The width of the large width section 62 is slightly smaller than the inner diameter of the outer cylinder 10. The second seal 64 is attached to both edges 62*a* of the large width section 62. The gap between the second partition wall 60 and the inner peripheral surface of the outer cylinder 10 is closed by the second seal 64.

As illustrated in FIG. 6, the second seal 64 according to the first embodiment is disposed so as to extend between the surface 60*b* of the second partition wall 60 on the second tube chamber 15*b* side and the inner peripheral surface 10*c* of the outer cylinder 10. The second seal 64 can use a so-called lamiflex seal plate or the like formed in a sheet shape like the first seal 44. The second seal 64 according to the first embodiment is fixed to the second partition wall 60 with bolts, and is installed in a state of being elastically deformed and being curved so that a concave curved surface is disposed on the second tube chamber 15*b* side which is a high-pressure side. The method of fixing the second seal 64 to the second partition wall 60 is not limited to bolting.

As illustrated in FIG. 1, the first baffle 70*a* is disposed in the second tube chamber 15*b* and changes the flow direction of the tube-exterior fluid Fo flowing in the second tube chamber 15*b*. The first baffle 70*a* is provided along an imaginary plane extending in the intersecting direction with respect to the axial direction Dx in which the outlet side tube section 33*b* extends. The first baffle 70*a* illustrated in the present embodiment is provided along an imaginary plane (not illustrated) extending in a direction perpendicular to the axis X. Moreover, a plurality of first baffles 70*a* are provided at intervals in the axial direction Dx. The first baffle 70*a* is formed with a first tube hole 71 through which the outlet side tube section 33*b* is inserted.

The first baffles 70*a* adjacent to each other in the axial direction Dx have windows 72 at positions shifted from each other when viewed from the axial direction Dx. Here, the tube-exterior fluid Fo flowing in the axial direction Dx through the window section 72 of one first baffle 70*a* is deflected by a section other than the window section 72, of a first baffle 70*a* adjacent to the first baffle 70*a* in the axial direction Dx, and flows in the direction intersecting the axis X to the window section 72 of the adjacent first baffle 70*a* in the axial direction Dx. That is, the first baffle 70*a* forms an intersecting direction flow path CP configured to flow the tube-exterior fluid Fo in a direction intersecting the axis X, that is, in a direction intersecting the outlet side tube section 33*b*.

The second baffle 70*b* is disposed in the first tube chamber 15*a* and changes the flow direction of the tube-exterior fluid Fo flowing in the first tube chamber 15*a*. The second baffle 70*b* is provided along an imaginary plane (not illustrated) extending in the intersecting direction with respect to the axial direction Dx in which the inlet side tube section 33*a* extends. The second baffle 70*b* illustrated in the first embodiment is provided along an imaginary plane (not illustrated) extending in a direction perpendicular to the axis X. Additionally, a plurality of second baffles 70*b* are provided at intervals in the axial direction Dx. The second baffle 70*b* is formed with a second tube hole 73 through which the inlet side tube section 33*a* is inserted.

Like the first baffle 70*a*, the second baffles 70*b* adjacent to each other in the axial direction Dx have windows 74 at positions shifted from each other when viewed from the axial direction Dx. That is, the tube-exterior fluid Fo flowing in the axial direction Dx through the window section 74 of one second baffle 70*b* is deflected by a section other than the window section 74 of another second baffle 70*b* adjacent to the second baffle 70*b* in the axial direction Dx, and flows in the direction intersecting the axis X to the window section 74 of the another second baffle 70*b* adjacent to the second baffle 70*b* in the axial direction Dx. Similar to the first baffle 70*a*, the second baffle 70*b* also forms an intersecting direction flow path CP configured to flow the tube-exterior fluid Fo in a direction intersecting the axis X, that is, in a direction intersecting the inlet side tube section 33*a*. In the first baffle 70*a* and the second baffle 70*b*, the number of windows formed per baffle is not limited to one, and for example, two or more windows may be formed. The flow path in which the tube-exterior fluid Fo flows is not limited to the single segmental type illustrated in FIG. 1. For example, other systems such as a double segmental type and an NTIW (No Tube In Window) type may be used.

Figure 7:
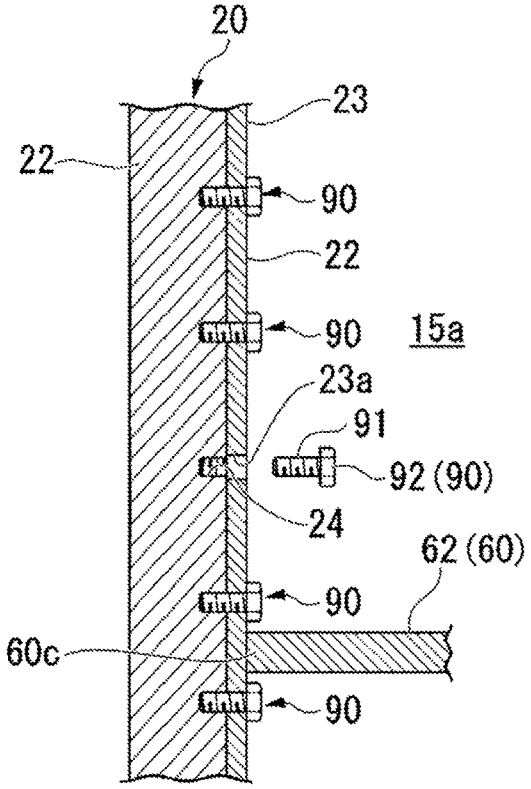
FIG. 7 is an enlarged cross-sectional view of a tube plate according to the first embodiment of the present invention.

FIG. 7 is an enlarged cross-sectional view of a tube plate according to the first embodiment of the present invention.

As illustrated in FIG. 1 and FIG. 7, the tube plate 20 according to the first embodiment includes a tube plate base material 22, a first backplate 23, and a screw fastener 90 (see FIG. 7).

The inlet ends 31 and the outlet ends 32, of the plurality of heat transfer tubes 30 described above, are fixed to the tube plate base material 22. The tube plate base material 22 has strength that can withstand the pressure of the tube-exterior fluid Fo and the tube-interior fluid Fi. As a material for forming the tube plate base material 22, for example, carbon steel can be used. That is, the material of the tube plate base material 22 according to the first embodiment is a metal to which chromium or the like capable of improving corrosion resistance is not intentionally added.

The first backplate 23 is disposed so as to be in contact with the surface of the tube plate base material 22 on the side of the tube-exterior fluid chamber 18. The first backplate 23 is formed in a plate shape thinner than the tube plate base material 22, and covers the surface of the tube plate base material 22 on the side of the tube-exterior fluid chamber 18 from the second end side D2. The first backplate 23 according to the present embodiment is formed in a disk shape, and covers substantially the entire surface 22*a* of the tube plate base material 22 on the side of the tube-exterior fluid chamber 18. The first backplate 23 is joined to an end section 60*c* of the second partition wall 60 on the first end side D1 by welding or the like. The first backplate 23 is made of a metal material having a higher corrosion resistance than the tube plate base material 22. As a metal material having high corrosion resistance, for example, a metal having a higher chromium content than the tube plate base material 22, such as stainless steel, can be exemplified. The first backplate 23 may be formed of the same material as the second partition wall 60.

The first backplate 23 includes a screw insertion hole 23*a* and a plurality of heat transfer tube insertion holes 23*b* (see FIG. 1). The heat transfer tube insertion hole 23*b* (see FIG. 1) is formed to have a diameter slightly larger than the diameter of the heat transfer tube 30, and each of the heat transfer tubes 30 described above is inserted therein. The screw insertion hole 23*a* is a through hole into which a screw shaft section 91 of a screw fastener 90 having male threads is loosely inserted. Here, the "loosely inserted" means, for example, a state in which the inner diameter of the screw insertion hole 23*a* is formed to be larger than the diameter of the screw shaft section 91, and the screw shaft section 91 is not fastened to the first backplate 23 by being screwed on, but is simply inserted. That is, the screw shaft section 91 can be slightly displaced in a direction intersecting the extending direction of the screw shaft section 91 inside the screw insertion hole 23*a*.

The screw fastener 90 couples the first backplate 23 to the tube plate base material 22 by being screwed on. The screw fastener 90 according to the first embodiment includes a bolt 92 having the above-described screw shaft section 91 and female threads 24 formed in the tube plate base material 22. That is, the first backplate 23 is bolted to the surface facing the second end side D2 of the tube plate base material 22 at a plurality of positions by the screw fasteners 90. Additionally, the screw fastener 90 may have a structure that can be fastened by being screwed on, and in addition to the combination of the bolt 92 and the female threads 24 formed in the tube plate base material 22, a combination of a bis and a bis hole, and a combination of stud bolts that are inserted and secured to the tube plate base material 22 and nuts, or the like, may be used.

The heat exchanger 100 according to the first embodiment has the above-described configuration. Next, the operation of the heat exchanger 100 will be described with reference to FIG. 1.

The heat exchanger 100 according to the first embodiment heats the gas turbine fuel, which is a corrosive fluid containing sulfur or the like, as the tube-exterior fluid Fo. In this heat exchanger, the tube-interior fluid Fi flows in from the tube-interior side inlet nozzle 16*a*, and the tube-exterior fluid Fo flows in from the first nozzle stub 14*a*.

First, the tube-interior fluid Fi is pressure-fed by a pump or the like and flows from the tube-interior side inlet nozzle 16*a* into the inlet chamber 17A. The tube-interior fluid Fi flowing into the inlet chamber 17A flows from the inlet end 31 of the heat transfer tube 30 into the tube-interior flow path inside the heat transfer tube 30, and reaches the outlet end 32 via the inlet side tube section 33*a*, the curved-tube section 34, and the outlet side tube section 33*b*. The tube-interior fluid Fi reaching the outlet end 32 flows out to the outlet chamber 17B, and then flows out to the outside of the outer cylinder 10 from the tube-interior side outlet nozzle 16*b*.

On the other hand, the tube-exterior fluid Fo flows from the first nozzle stub 14*a* into the second tube chamber 15*b* via the cylinder-interior inlet flow path 25 formed between the inner cylinder 40 and the outer cylinder 10. Here, the space S1 formed between the inner cylinder 40 and the outer cylinder 10 is partitioned by the space partition member 43 in the axial direction Dx. The pressure P1 of the tube-exterior fluid Fo acting on the surface 43*b* on the first end side D1 of the space partition member 43 is lower than the pressure P2 of the tube-exterior fluid Fo acting on the surface 43*a* on the second end side D2 (P1<P2). This is because the pressure of the tube-exterior fluid Fo outside the tube on the first end side D1 decreases due to pressure loss occurring in the first tube chamber 15*a* and the second tube chamber 15*b*. Since the first seal 44 is provided between the space partition member 43 and the inner peripheral surface 10*c* of the outer cylinder 10, leakage of the tube-exterior fluid Fo, due to the pressure difference, from the gap between the space partition member 43 and the inner peripheral surface 10*c* of the outer cylinder 10 is suppressed.

The tube-exterior fluid Fo flowing into the second tube chamber 15*b* flows from the first end side D1 toward the second end side D2 inside the second tube chamber 15*b* formed inside the inner cylinder 40. At this time, the tube-exterior fluid Fo flows in the meandering flow path formed by the inner cylinder 40, the second partition wall 60, and the plurality of first baffles 70*a*. That is, the tube-exterior fluid Fo flows from the first end side D1 to the second end side D2 while meandering in the second tube chamber 15*b*. In the process of flowing through the second tube chamber 15*b*, the tube-exterior fluid Fo exchanges heat with the tube-interior fluid Fi flowing through the plurality of outlet side tube sections 33*b*.

The tube-exterior fluid Fo flowing to the second end side D2 of the second tube chamber 15*b* flows into the first tube chamber 15*a* through the opening of the opening forming section 63 formed endmost to the second end side D2 of the small width section 61 of the second partition wall 60. The tube-exterior fluid Fo flowing into the first tube chamber 15*a* flows in the first tube chamber 15*a* from the second end side D2 toward the first end side D1. In other words, the direction in which the tube-exterior fluid Fo flows is reversed at the opening forming section 63. Further, in other words, the opening forming section 63 serves as a return section of the flow path through which the tube-exterior fluid Fo flows.

The tube-exterior fluid Fo flowing into the first tube chamber 15*a* flows through a meandering flow path formed by the inner cylinder 40, the second partition wall 60, and the plurality of second baffles 70*b* in the same manner as when flowing through the second tube chamber 15*b*. That is, the tube-exterior fluid Fo flows from the second end side D2 to the first end side D1 while meandering in the first tube chamber 15*a*. The tube-exterior fluid Fo exchanges heat with the internal tube-interior fluid Fi flowing in the plurality of inlet side tube sections 33*a* in the process of flowing in the first tube chamber 15*a*. Additionally, the tube-exterior fluid Fo having exchanged heat with the internal tube-interior fluid Fi in the inlet side tube sections 33*a* flows from the opening of the inner cylinder 40 into the cylinder-interior outlet flow path 26 between the inner surface of the outer cylinder 10 and the outer surface of the inner cylinder 40. At this time, the tube-exterior fluid Fo comes into contact only with the first backplate 23 of the tube plate 20, and flows into the cylinder-interior outlet flow path 26 without coming into contact with the tube plate base material 22. Here, the tube-exterior fluid Fo flowing into the cylinder-interior outlet flow path 26 is heated to a high temperature, and the tube plate 20 and the outer cylinder 10 on the first tube chamber 15*a* side are also heated by this high-temperature tube-exterior fluid Fo. The tube-exterior fluid Fo flowing into the cylinder-interior outlet flow path 26 flows out to the outside of the outer cylinder 10 from the second nozzle stub 14*b*.

According to the heat exchanger 100 of the first embodiment described above, on the surface 22*a* of the tube plate base material 22 on the first tube chamber 15*a* side, a first backplate 23 formed of a material having higher corrosion resistance than the tube plate base material 22 is arranged. Therefore, when the tube-exterior fluid Fo flowing in the first tube chamber 15*a* becomes higher in temperature than the tube-exterior fluid Fo flowing in the second tube chamber 15*b*, progression of corrosion by the surface 22*a* of the tube plate base material 22 on the first tube chamber 15*a* side contacting the tube-exterior fluid Fo having increased corrosiveness can be suppressed. Further, the first backplate 23 is connected to the tube plate base material 22 by a screw fastener 90 and is joined to the end section of the second partition wall 60 on the first end side D1. That is, the first backplate 23 is joined only to the second partition wall 60, not to the outer cylinder 10, and is fixed to the tube plate base material 22 only by a screw fastener 90 in which the screw shaft section 91 is loosely inserted into the screw insertion hole 23*a*. Therefore, even in a case where a difference in thermal elongation occurs between the tube plate base material 22 and the outer cylinder 10 and the first backplate 23, when the force acting on the first backplate 23 due to this thermal elongation difference exceeds the fixing force by the screw fastener 90, the first backplate 23 can be slightly displaced with respect to the screw fastener 90 to allow the first backplate 23 to escape. Therefore, it is possible to suppress an excessive stress from being applied to the first backplate 23 due to the thermal elongation difference. Therefore, it is possible to suppress an increase in manufacturing cost and progression of corrosion, and to suppress a decrease in durability.

Moreover, the inner cylinder 40 and the space partition member 43 are made of a material having a higher corrosion resistance than the tube plate base material 22. Therefore, even when the external tube-exterior fluid Fo, which is a high-temperature corrosive fluid, flows in the first tube chamber 15*a*, corrosion of the inner cylinder 40 and the space partition member 43 can be suppressed. Further, the inner cylinder 40 and the second partition wall 60 are joined, and the space partition member 43 is not joined to the outer cylinder 10. Therefore, even when a thermal elongation difference occurs between the outer cylinder 10, the inner cylinder 40, and the space partition member 43, the inner cylinder 40 and the space partition member 43 are displaced relative to the outer cylinder 10, so that stress applied to the space partition member 43 and the inner cylinder 40 can be suppressed.

Further, even when a gap is formed between the space partition member 43 and the outer cylinder 10, the gap is closed by the first seal 44, and therefore, the flow of the tube-exterior fluid Fo through the gap can be prevented. Consequently, a decrease in heat exchange efficiency can be suppressed.

Similarly, even when a gap is formed between the second partition wall 60 and the outer cylinder 10, since the gap between the second partition wall 60 and the outer cylinder 10 is closed by the second seal 64, it is possible to prevent the flow of the tube-exterior fluid Fo between the first tube chamber 15*a* and the second tube chamber 15*b*. Therefore, a decrease in heat exchange efficiency can be suppressed.

Second Embodiment

Next, a heat exchanger according to a second embodiment of the present invention will be described with reference to the drawings. The heat exchanger according to the second embodiment is different from the heat exchanger according to the first embodiment only in that a second backplate 27 is further provided. Therefore, the same components as those in the first embodiment are denoted by the same reference numerals, and redundant description is omitted.

Figure 8:
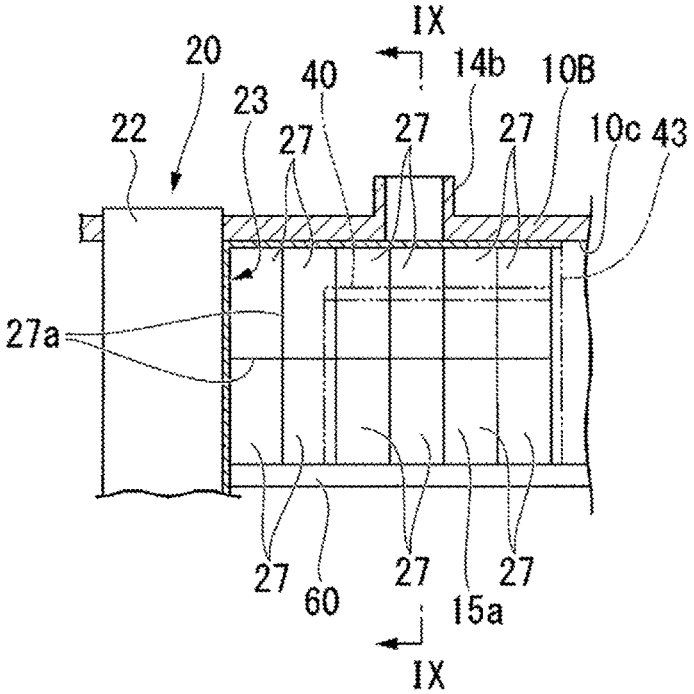
FIG. 8 is a partial cross-sectional view of an outer cylinder of a heat exchanger according to a second embodiment of the present invention.
Figure 9:
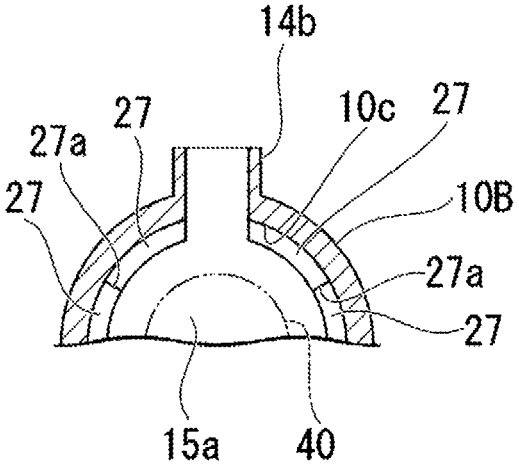
FIG. 9 is a cross-sectional view taken along the IX-IX line of FIG. 8.

FIG. 8 is a partial cross-sectional view of the outer cylinder of the heat exchanger according to the second embodiment of the present invention. FIG. 9 is a cross-sectional view taken along the IX-IX line of FIG. 8.

As illustrated in FIG. 8 and FIG. 9, the outer cylinder 10B of the heat exchanger according to the second embodiment includes a second backplate 27. The second backplate 27 is disposed so as to cover the region between the space partition member 43 on the first tube chamber 15*a* side of the second partition wall 60 and the tube plate 20 in the inner peripheral surface 10*c* of the outer cylinder 10B. In the second embodiment, the inner peripheral surface 10*c* of the outer cylinder 10B is covered with a plurality of second backplates 27.

The plurality of second backplates 27 are formed in, for example, a rectangular shape curved along a curved surface of the inner peripheral surface 10*c* of the outer cylinder 10B, and are arranged such that the longitudinal direction thereof faces the circumferential direction centered around the axis X. While the outer cylinder 10B is made of a metal such as carbon steel, the second backplate 27, like the first backplate 23, is made of a metal such as stainless steel, which has higher corrosion resistance than the outer cylinder 10B. Further, the second backplate 27 is formed thinner than the outer cylinder 10B. The peripheral edge section 27*a* of the second backplate 27 is joined to the inner peripheral surface 10*c* of the outer cylinder 10B by building up welding or the like. The gap between the adjacent second backplates 27 is also filled by building up welding or the like. It should be noted that the second backplate 27 may be formed by adding spot welding to a section inside the peripheral edge section 27*a* so that a section inside the peripheral edge section 27*a* does not float from the inner peripheral surface 10*c* of the outer cylinder 10B.

According to the second embodiment, of the inner peripheral surface 10*c* of the outer cylinder 10B, the region between the space partition member 43 and the tube plate 20, which is provided with the second nozzle stub 14*b*, is covered with the second backplate 27. Therefore, when the tube-exterior fluid Fo, which is a high-temperature corrosive fluid, flows out from the second nozzle stub 14*b*, it is possible to prevent the tube-exterior fluid Fo from coming into contact with the inner peripheral surface 10*c* of the outer cylinder 10B.

Further, since the inner peripheral surface 10*c* of the outer cylinder 10B is covered with a plurality of second backplates 27, deformation of the second backplate 27 caused by a thermal elongation difference in the axial direction Dx between the outer cylinder 10B and the second backplate 27, for example, can be suppressed. Further, since the second backplate 27 is formed in a rectangular shape, the workability in attaching the second backplate 27 to the inner peripheral surface 10*c* can be improved.

Next, modified examples of each of the above-described embodiments will be described. Moreover, the same components as those in each embodiment described above are denoted by the same reference numerals, and redundant descriptions are omitted.

First Modified Example

Figure 10:
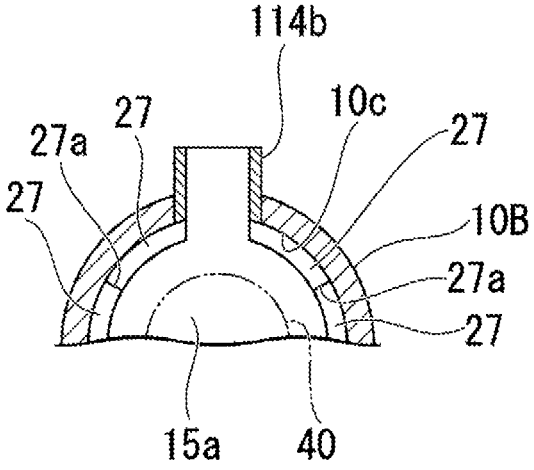
FIG. 10 is a cross-sectional view illustrating a second nozzle stub according to a first modified example of an embodiment of the present invention.

FIG. 10 is a cross-sectional view illustrating a second nozzle stub according to a first modified example of the embodiment of the present invention. In the first and second embodiments described above, the case where the second nozzle stub 14*b* is formed of the same material as that of the outer cylinder 10 is exemplified. However, as with the first backplate 23 and the second backplate 27, a metal material having a higher corrosion resistance than the outer cylinder 10 may be used, as in the case of the second nozzle stub 14*b* of the first modified example illustrated in FIG. 10. With such a configuration, it is possible to suppress the progression of the corrosion of the second nozzle stub due to the contact of the high-temperature tube-exterior fluid Fo.

Second Modified Example

Figure 11:
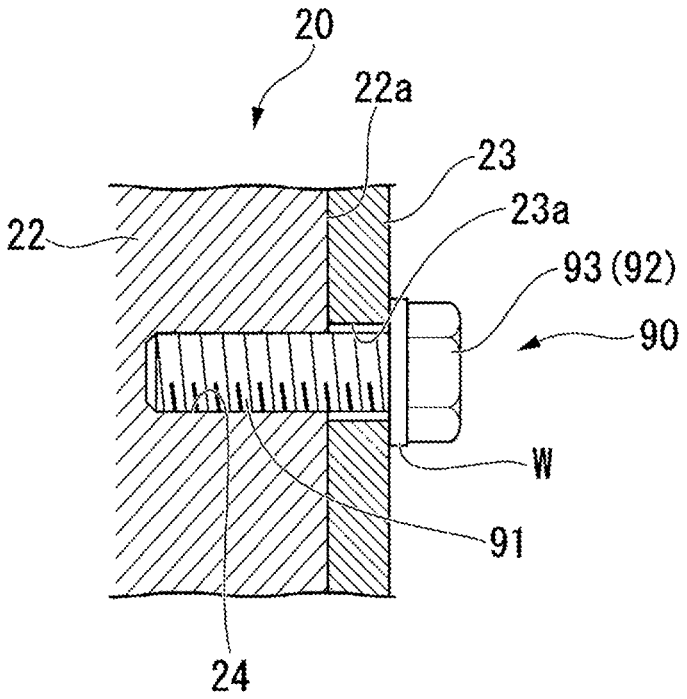
FIG. 11 is an enlarged cross-sectional view of a vicinity of a screw insertion hole of a tube plate according to a second modified example of an embodiment of the present invention.

FIG. 11 is an enlarged cross-sectional view of the vicinity of the screw insertion hole of the tube plate according to the second modified example of the embodiment of the present invention.

For example, as illustrated in FIG. 11, the above-described screw fastener 90 may further include a washer W through which the screw shaft section 91 can be inserted. The washer W has an inner diameter larger than the outer diameter of the screw shaft section 91 and smaller than the inner diameter of the screw insertion hole 23*a*. The washer W may have an outer diameter larger than the inner diameter of the screw insertion hole 23*a*. In the second modified example, a case where a screw fastener 90 includes a bolt 92 is exemplified. The inner diameter of the washer W according to the second modified example is smaller than a diameter of the inscribed circle of a hexagon of the bolt head 93. The inner diameter of the washer W may be smaller than a bis head when using a bis instead of the bolt 92, and smaller than the diameter of an inscribed circle of the nut when using a stud bolt.

According to the second modified example, the gap between the screw insertion hole 23*a* and the screw shaft section 91 is closed by the washer W, so that the intrusion of the tube-exterior fluid Fo into the gap between the tube plate base material 22 and the first backplate 23 can be reduced. As a result, corrosion of the tube plate base material 22 can be prevented.

Third Modified Example

In the first embodiment described above, a case where the first seal 44 and the second seal 64, which are in the form of sheets bent by elastic deformation, such as a lamiflex seal are respectively used, has been described. However, the sealing structure between the second partition wall 60 and the inner peripheral surface of the outer cylinder 10 is not limited to the above-described sealing structure of the first embodiment.

Figure 12:
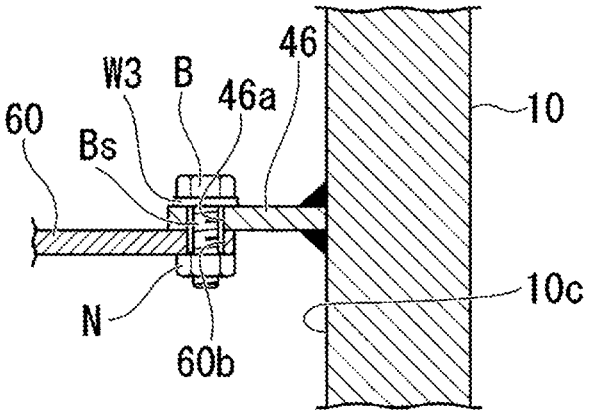
FIG. 12 is a cross-sectional view illustrating a seal structure between a second partition wall and an inner peripheral surface of an outer cylinder according to a third modified example of the present invention.
Figure 13:
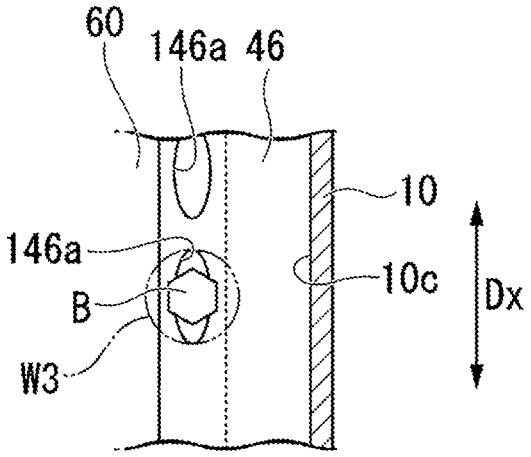
FIG. 13 is a view illustrating another aspect of a screw insertion hole of a receiving plate according to the third modified example of the present invention.

FIG. 12 is a cross-sectional view illustrating a seal structure between the second partition wall and the inner peripheral surface of the outer cylinder according to the third modified example of the present invention. FIG. 13 is a view illustrating another aspect of the third modified example of the present invention in which the screw insertion hole of the receiving plate is viewed from the above.

As illustrated in FIG. 12, the receiving plate 46 is joined by welding or the like to the inner peripheral surface 10*c* of the outer cylinder 10 according to the third modified example. The receiving plate 46 is continuous in the axial direction Dx along the second partition wall 60. The receiving plate 46 is connected to the second partition wall 60 by bolt B and nut N.

Each of the screw insertion hole 46*a* and 60*b* formed in the receiving plate 46 and the second partition wall 60 has an inner diameter larger than the diameter of the screw shaft section Bs of the bolt B, and the screw shaft section Bs inserted through the screw insertion hole 46*a* and 60*b* can be displaced in a direction intersecting the screw shaft section Bs within the range of the screw insertion hole 46*a* and 60*b* when an input is applied exceeding the coupling force of the bolt B and the nut N. In this third modified example, one annular washer W3 is used for one set of bolt B and nut N. Like the above-described washer W2, the inner diameter of the washer W3 is smaller than the inscribed circle of the bolt head and slightly larger than the diameter of the screw shaft section Bs. The outer diameter of the washer W3 is larger than the circumscribed circle of the bolt head. Additionally, as illustrated in FIG. 13, the screw insertion hole 46*a* may be, like the screw insertion hole 146*a* of the receiving plate 46, a long hole which is long in the axial direction Dx. Similarly, the screw insertion hole 60*b* of the second partition wall 60 may be a long hole. In FIG. 13, the washer W3 is illustrated by two-dot chain line, but the washer W3 may be omitted.

Therefore, according to the third modified example, as in the first embodiment, excessive stress can be prevented from being applied to the second partition wall 60 due to the thermal elongation difference between the outer cylinder 10 and the second partition wall 60 of different materials, while suppressing the outflow of the tube-exterior fluid Fo from the high-pressure side to the low-pressure side.

Fourth Modified Example

Figure 14:
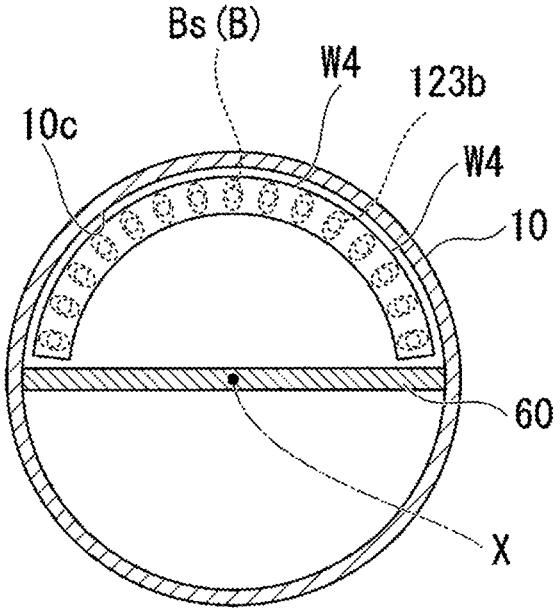
FIG. 14 is a view illustrating a washer according to a fourth modified example of an embodiment of the present invention.

FIG. 14 illustrates a washer according to a fourth modified example of the embodiment of the present invention.

In the above-described third modified example, a case where one annular washer W is used for one set of bolt B and nut N is exemplified. However, the shape of the washer W is not limited to this shape. For example, as illustrated in FIG. 14, a washer W4 formed so as to extend through a plurality of screw insertion holes 123*b* may be used. In this way, the number of parts can be reduced and the burden on the assembly worker can be reduced. Additionally, the washer W3 illustrated in FIG. 12 and FIG. 13 may also be replaced with a washer (not illustrated) extending in the axial direction Dx formed so as to extend through a plurality of screw insertion holes 46*a* or a plurality of screw insertion holes 60*b*.

Fifth Modified Example

Figure 15:
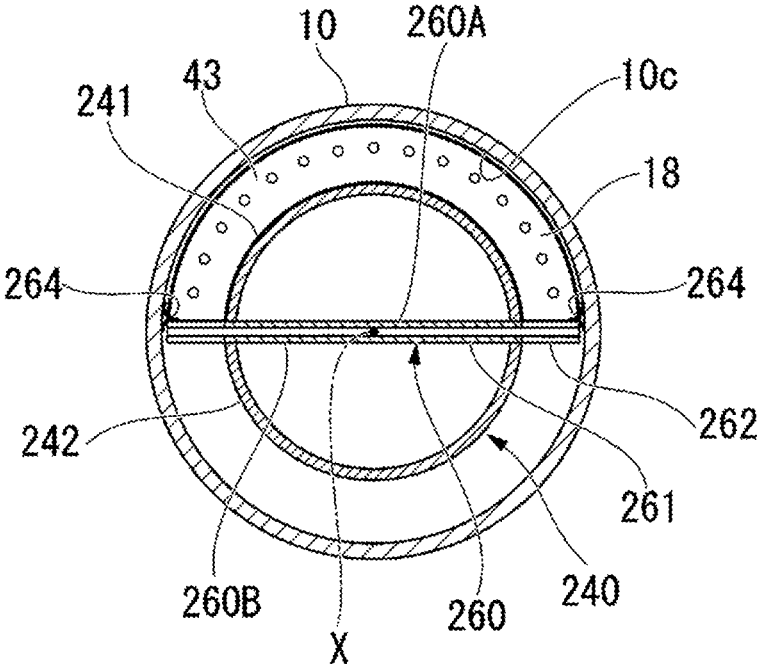
FIG. 15 is a cross-sectional view corresponding to FIG. 4 according to a fifth modified example of an embodiment of the present invention.
Figure 16:
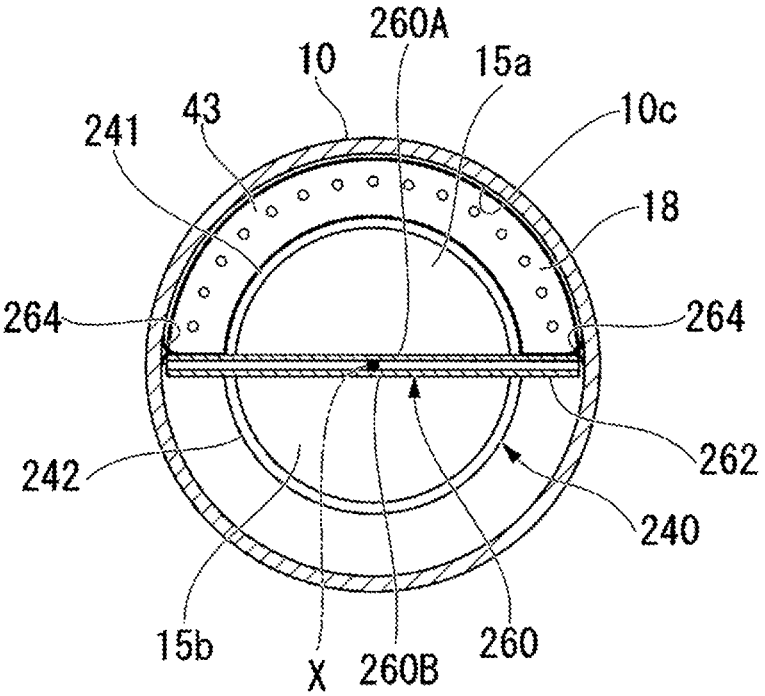
FIG. 16 is a cross-sectional view corresponding to FIG. 5 according to the fifth modified example of an embodiment of the present invention.

FIG. 15 is a cross-sectional view corresponding to FIG. 4 according to the fifth modified example of the embodiment of the present invention. FIG. 16 is a cross-sectional view corresponding to FIG. 5 according to the fifth modified example of the embodiment of the present invention.

In the above-described embodiments and the respective modified examples, the case where the second partition wall 60 is formed of one flat plate is exemplified. However, the second partition wall is not limited to a single plate.

For example, the second partition wall may have a multiple structure such as a second partition wall according to the fifth modified example illustrated in FIG. 15 and FIG. 16. Although FIG. 15 and FIG. 16 illustrate a double structure as an example of the multiple structure, the multiple structure may be a double structure or more.

As illustrated in FIG. 15 and FIG. 16, the second partition wall 260 of the fifth modified example includes a first plate section 260A, a second plate section 260B, and a spacer (not illustrated).

The first plate section 260A is arranged on the first tube chamber 15*a* side, and the second plate section 260B is arranged on the second tube chamber 15*b* side. The first plate section 260A and the second plate section 260B are spaced apart from each other by a spacer (not illustrated).

The second partition wall 260 thus formed has a small width section 261 and a large width section 262 as in the above-described embodiment. The edge sections of the small width section 261 are respectively separated apart from the inner peripheral surface 10*c* of the outer cylinder 10. The edge sections of the large width section 262 are slightly separated respectively from the inner peripheral surface 10*c* of the outer cylinder 10. A second seal 264 configured to close the gap between the first plate section 260A and the inner peripheral surface of the outer cylinder 10 is attached to the edge section of the large width section 262 of the first plate section 260A, similarly to the second seal 64 of the above-described embodiment.

Although FIG. 15 and FIG. 16 illustrate a case where the second seal 264 is attached so as to be curved toward both the first tube chamber 15*a* side and the second tube chamber 15*b* side, only one of the first tube chamber 15*a* side and the second tube chamber 15*b* side may be provided.

In the opening forming section (not illustrated; equivalent to the opening forming section 63 of the embodiment) formed on the second end side D2 of the second partition wall 260, a leak preventing spacer (not illustrated) is provided in the gap so as to surround the opening forming section in order to prevent the tube-exterior fluid Fo from leaking from the gap between the first plate section 260A and the second plate section 260B.

The inner cylinder 240 according to the fifth modified example includes a first half section 241 and a second half section 242 each formed in a half-cylinder shape extending in the axial direction Dx. The first half section 241 and the second half section 242 of the fifth modified example are each formed in a semicircular arc shape in cross section perpendicular to the axis X. Both end edges of the first half section 241 in the circumferential direction centered around the axis X are joined to the surface of the first plate section 260A by welding or the like. Similarly, both end edges of the second half section 242 in the circumferential direction centered around the axis X are joined to the surface of the second plate section 260B by welding or the like.

The space partition member 43 has the same configuration as that of the above-described embodiment, and is joined to the first half section 241 of the inner cylinder 240 and the first plate section 260A by welding or the like. The space partition member 43 is not joined to the inner peripheral surface of the outer cylinder 10 by welding or the like, but instead includes a first seal 44 (not illustrated) made of a lamiflex seal or the like configured to close a gap generated between the space partition member 43 and the inner peripheral surface 10*c* of the outer cylinder 10.

Therefore, according to the fifth modified example, for example, the heat exchanger can be assembled by inserting the first unit in which the first plate section 260A, the first half section 241, and the space partition member 43 are joined, and the second unit in which the second plate section 260B and the second half section 242 are joined, into the outer cylinder 10, respectively. Therefore, the heat exchanger can be easily assembled. Further, according to the fifth modified example, the second partition wall 260 has a multiple structure, whereby the heat insulation performance of the second partition wall 260 can be improved.

Other Modified Examples

The present invention is not limited to the above-described embodiments, and includes the above-described embodiments with various modifications added thereto without departing from the spirit of the present invention. That is, the specific shape, configuration, or the like described in the embodiments are merely examples, and can be changed as appropriate.

Although the present invention has been applied to a heat exchanger in which a heat transfer tube is formed in a U-shape, the heat transfer tube is not limited to a U-shape heat exchanger.

Further, as a fastener having a shaft section, a screw fastener in which an external screw is formed on a screw shaft section is exemplified, but a fastener such as a rivet may be used.

Further, in the first embodiment described above, the case where the tube-exterior fluid Fo is heated has been described, but the heat exchanger according to the present invention is also applicable to the case where the tube-exterior fluid Fo is cooled. In this case, the high-temperature tube-exterior fluid Fo flows into the outer cylinder 10 from the second nozzle stub 14*b* and flows out from the first nozzle stub 14*a* to the outside of the outer cylinder 10. Further, tube-interior fluid Fi serving as a refrigerant may flow from the outlet end 32 to the inlet end 31. Also in this case, since the temperature of the tube-exterior fluid Fo just after flowing in from the second nozzle stub 14*b* is high, it is possible to suppress the progression of corrosion due to the tube-exterior fluid Fo having a high temperature, and to suppress the increase in manufacturing cost and the deterioration of durability due to the stress caused by the thermal elongation difference.

Furthermore, in each of the embodiments described above, the case where the first backplate 23 is formed in a disk shape has been exemplified. However, the first backplate 23 only needs to cover a section of the tube plate base material 22 that faces at least the first tube chamber 15*a*. That is, the first backplate may be formed in a semicircular disk shape.

Further, in the first embodiment described above, the case where the first backplate 23 is in close contact with the tube plate base material 22 has been described. However, a gap may be formed between the first backplate 23 and the tube plate base material 22.

Further, although the heat exchanger 100 described above is used as a heat exchanger for increasing the temperature of the fuel gas of the gas turbine, it can be used for heat exchange for other than the fuel gas of the gas turbine as long as the corrosive fluid is an external tube-exterior fluid Fo.

INDUSTRIAL APPLICABILITY

The present invention is applicable to a heat exchanger. According to the present invention, it is possible to suppress an increase in manufacturing cost and progression of corrosion, and to suppress a decrease in durability.

REFERENCE SIGNS LIST

10 Outer cylinder
10*a* First end
10*b* Second end
10B Outer cylinder
10*c* Inner peripheral surface
11 Trunk part
12 First end plate
13 Second end plate
14*a* First nozzle stub

14*b* Second nozzle stub
15*a* First tube chamber
15*b* Second tube chamber
16*a* Tube-interior side inlet nozzle
16*b* Tube-interior side outlet nozzle
17 Tube-interior fluid chamber
17A Inlet chamber
17B Outlet chamber
18 Tube-exterior fluid chamber
19 Curved-tube chamber
20 Tube plate
21 Tube hole
22 Tube plate base material
22*a* Surface
23 First backplate
23*a* Screw insertion hole
23*b* Heat transfer tube insertion hole
24 Female threads
25 Cylinder-interior inlet flow path
26 Cylinder-interior outlet flow path
27 Second backplate
27*a* Peripheral edge section
30 Heat transfer tube
31 Inlet end
32 Outlet end
33 Straight-tube section
33*a* Inlet side tube section
33*b* Outlet side tube section
33Ga Inlet side tube group
33Gb Outlet side tube group
34 Curved-tube section
34*a* Maximum curved-tube section
40 Inner cylinder
41 Trunk part
41*a* Outer peripheral surface
42 End plate
43 Space partition member
43*a* Edge section
43*b* Surface
44 First seal
45*a* Screw insertion hole
46 Receiving plate
46*a* Screw insertion hole
50 First partition wall
60 Second partition wall
60*a* Surface
60*b* Screw insertion hole
60*c* End section
61 Small width section
61*a* Both edge sections
61*c* End section
62 Large width section
62*a* Both edge sections
63 Opening forming section
64 Second seal
70*a* First baffle
70*b* Second baffle
71 First tube hole
72 Window section
73 Second tube hole
74 Window section
80 Tube support plate
81 Tube hole
90 Screw fastener
91 Screw shaft section
92 Bolt
93 Bolt head
100 Heat exchanger
114*b* Second nozzle stub
123*b* Screw insertion hole
146*a* Screw insertion hole
240 Inner cylinder
241 First half section
242 Second half section
260 Second partition wall
260A First plate section
260B Second plate section
261 Small width section
262 Large width section
264 Second seal
B Bolt
Bs Screw shaft section
CP Intersecting direction flow path
D1 First end side
D2 Second end side
Fi Tube-interior fluid
Fo Tube-exterior fluid
N Nut
S1 Space
W, W2, W3, W4 Washer
X Axis

The invention claimed is:

1. A heat exchanger comprising:

an outer cylinder having a cylindrical shape with both ends closed;

a tube plate partitioning, at a position close to a first end of the both ends, an inside of the outer cylinder into a tube-interior fluid chamber on a side where the first end is located and a tube-exterior fluid chamber on a side where a second end is located;

a plurality of heat transfer tubes arranged in the tube-exterior fluid chamber and including at least one end that is fixed to the tube plate and faces the tube-interior fluid chamber; and a partition wall partitioning the tube-exterior fluid chamber into a first tube chamber, in which an inlet side tube group is present as a collection of inlet side tube sections extending from inlet ends of the plurality of heat transfer tubes, and a second tube chamber, in which an outlet side tube group is present as a collection of outlet side tube sections extending from outlet ends of the plurality of heat transfer tubes, wherein the tube plate includes a tube plate base material to which end sections of the plurality of heat transfer tubes are fixed, a first backplate covering a surface of the tube plate base material on a side where the first tube chamber is located, and a fastener that includes at least a shaft section and is configured to fix the first backplate to the tube plate base material;

the first backplate includes heat transfer tube insertion holes through which the plurality of heat transfer tubes are inserted, and an insertion hole through which the shaft section is inserted;

the first backplate is joined to an end section of the partition wall on the side where the first end is located;

the partition wall, the first backplate, and the fastener are formed of a material having a higher corrosion resistance than the tube plate base material;

the heat exchanger further comprises:

an inner cylinder arranged in the tube-exterior fluid chamber and covering the plurality of heat transfer tubes and the partition wall;

a space partition member that is disposed between the outer cylinder and the inner cylinder and that partitions a space between the outer cylinder and the inner cylinder on the side where the first tube chamber is located into the side where the first end is located and the side where the second end is located;

a first nozzle stub provided in the outer cylinder at a position closer to the second end than to the space partition member on the side where the first tube chamber is located with respect to the partition wall or at a position on a side where the second tube chamber is located with respect to the partition wall; and a second nozzle stub provided in the outer cylinder on the side where the first tube chamber is located with respect to the partition wall and at a position between the space partition member and the tube plate, the inner cylinder is open on the side where the first end is located and is closed on the side where the second end is located;

the partition wall is joined to the inner cylinder to divide the inner cylinder into two sections in a radial direction to form the first tube chamber and the second tube chamber;

the space partition member is joined to an outer peripheral surface of the inner cylinder and is displaceable with respect to an inner peripheral surface of the outer cylinder without being joined to the inner peripheral surface of the outer cylinder; and the inner cylinder and the space partition member are formed of a material having a higher corrosion resistance than the tube plate base material.

2. The heat exchanger according to claim 1, comprising a second backplate that is disposed to cover a region between the space partition member and the tube plate on the side where the first tube chamber is located in the inner peripheral surface of the outer cylinder and that is formed of a material having a higher corrosion resistance than the outer cylinder.

3. The heat exchanger according to claim 1, comprising a first seal that is disposed to extend between the inner peripheral surface of the outer cylinder and either one of a surface, on the side where the first end is located, and a surface, on the side where the second end is located, of the space partition member and that closes a gap generated between the space partition member and the inner peripheral surface of the outer cylinder while allowing the space partition member to be displaceable with respect to the outer cylinder.

4. The heat exchanger according to claim 1, comprising a second seal that is disposed to extend between the inner peripheral surface of the outer cylinder and either one of a surface, on the side where the first tube chamber is located, and a surface, on the side where the second tube chamber is located, of the partition wall and that closes a gap generated between the partition wall and the inner peripheral surface of the outer cylinder while allowing the partition wall to be displaceable with respect to the outer cylinder.

5. The heat exchanger according to claim 2, wherein the second backplate is divided into a plurality of sections along the inner peripheral surface of the outer cylinder.

6. The heat exchanger according to claim 1, wherein the second nozzle stub is formed of a material having a higher corrosion resistance than the outer cylinder.

7. The heat exchanger according to claim 1, wherein the fastener includes a washer that has an inner diameter larger than an outer diameter of the shaft section and smaller than an inner diameter of the insertion hole and that has an outer diameter larger than an inner diameter of the insertion hole.

8. The heat exchanger according to claim 3, wherein the first seal is formed in a sheet shape elastically deformed so that a concave surface is disposed on a side in which pressure is relatively high.

9. The heat exchanger according to claim 4, wherein the second seal is formed in a sheet shape elastically deformed so that a concave surface is disposed on a side in which pressure is relatively high.

* * * * *